US008130116B1

(12) United States Patent
Daigle

(10) Patent No.: US 8,130,116 B1
(45) Date of Patent: Mar. 6, 2012

(54) MOBILE TELEPHONE TRACKING SYSTEM

(76) Inventor: Harold S. Daigle, Glace Bay (CA)

( * ) Notice: Subject to any disclaimer, the term of this patent is extended or adjusted under 35 U.S.C. 154(b) by 254 days.

(21) Appl. No.: 12/229,762

(22) Filed: Aug. 26, 2008

Related U.S. Application Data

(60) Provisional application No. 60/966,159, filed on Aug. 27, 2007.

(51) Int. Cl.
*G08B 17/10* (2006.01)

(52) U.S. Cl. ..... 340/686.6; 573/573.1; 573/539.15; 573/539.21; 573/539.23; 573/692

(58) Field of Classification Search ..... 340/573.1, 340/539.15, 539.21, 692, 539.23, 686.6
See application file for complete search history.

(56) References Cited

U.S. PATENT DOCUMENTS 4,101,873 A * 7/1978 Anderson et al. ..... 340/539.32
4,476,469 A * 10/1984 Lander ..... 340/8.1
4,961,575 A * 10/1990 Perry ..... 273/460
5,115,223 A * 5/1992 Moody ..... 340/573.1
5,214,410 A * 5/1993 Verster ..... 340/505
5,552,773 A * 9/1996 Kuhnert ..... 340/573.1
5,652,569 A * 7/1997 Gerstenberger et al. ... 340/573.4
5,677,673 A * 10/1997 Kipnis ..... 340/539.32
5,680,105 A * 10/1997 Hedrick ..... 340/571
5,689,238 A 11/1997 Cannon, Jr. et al.
5,712,899 A 1/1998 Pace, III
5,742,233 A * 4/1998 Hoffman et al. ..... 340/573.1
5,748,087 A * 5/1998 Ingargiola et al. ..... 340/573.7
5,841,352 A * 11/1998 Prakash ..... 340/573.4
5,873,041 A 2/1999 Ishii
5,939,981 A * 8/1999 Renney ..... 340/539.32
5,952,921 A * 9/1999 Donnelly ..... 340/568.6
5,963,131 A * 10/1999 D'Angelo et al. ..... 340/568.1
6,023,624 A 2/2000 Hanson
6,122,521 A 9/2000 Wilkinson et al.
6,133,832 A * 10/2000 Winder et al. ..... 340/572.1
6,236,319 B1 * 5/2001 Pitzer et al. ..... 340/573.4
6,265,974 B1 * 7/2001 D'Angelo et al. ..... 340/568.1
6,297,737 B1 * 10/2001 Irvin ..... 340/571
6,304,186 B1 * 10/2001 Rabanne et al. ..... 340/573.4
6,321,091 B1 11/2001 Holland
6,366,202 B1 * 4/2002 Rosenthal ..... 340/539.32
6,396,403 B1 * 5/2002 Haner ..... 340/573.4
6,501,378 B1 * 12/2002 Knaven ..... 340/539.1
(Continued)

*Primary Examiner* — Hoi Lau
(74) *Attorney, Agent, or Firm* — Montgomery Patent & Design, LLC; Robert C. Montgomery; Joseph T. Yaksich

(57) ABSTRACT

A personal item tracking and monitoring system is herein disclosed, comprising a transmitter unit and a receiver unit. The transmitter unit is a relatively small unit attachable to an object, particularly a mobile telephone, that emits a radio frequency coded signal to a receiving unit carried by a person. The transmitter unit is of a small size relative to the object and is attached to the object by use of a fastening means. The receiver unit is envisioned to be the size of a key fob typically used to wirelessly lock and unlock the doors of a motor vehicle. As such, the receiver unit is envisioned to be carried on a ring of keys, carried in one's hands, carried in a pocket, purse, or briefcase, worn upon a belt, or a similar manner. The receiving unit allows a user to adjust and set an allowable distance between the object and the receiver unit using a range selection control. If the object is located farther then the allowable distance the user is alerting by an audible or visual warning signal. In such a manner, the user may take immediate corrective action to retrieve the object, thus silencing the alarm.

21 Claims, 6 Drawing Sheets

U.S. PATENT DOCUMENTS 6,526,283 B1 2/2003 Jang
6,529,131 B2 * 3/2003 Wentworth ..... 340/573.1
6,535,125 B2 * 3/2003 Trivett ..... 340/539.13
6,573,832 B1 6/2003 Fugere-Ramirez
6,593,851 B1 * 7/2003 Bornstein ..... 340/539.15
6,624,752 B2 * 9/2003 Klitsgaard et al. ..... 340/572.1
6,788,199 B2 * 9/2004 Crabtree et al. ..... 340/539.13
6,888,463 B1 * 5/2005 Mengrone et al. ..... 340/571
6,944,443 B2 9/2005 Bates et al.
6,989,748 B2 * 1/2006 Rabanne et al. ..... 340/572.1
7,002,473 B2 * 2/2006 Glick et al. ..... 340/572.1
7,016,687 B1 3/2006 Holland
7,034,684 B2 * 4/2006 Boman et al. ..... 340/568.1
7,046,141 B2 * 5/2006 Pucci et al. ..... 340/539.32
7,148,801 B2 * 12/2006 Crabtree et al. ..... 340/539.13
7,259,671 B2 * 8/2007 Ganley et al. ..... 340/539.23
7,265,667 B2 * 9/2007 Goto et al. ..... 340/539.15
7,365,645 B2 * 4/2008 Heinze et al. ..... 340/572.1
7,417,558 B2 * 8/2008 Lightbody et al. ..... 340/870.21
7,446,664 B2 * 11/2008 White ..... 340/573.1
7,453,357 B2 * 11/2008 Bernal-Silva et al. ... 340/539.32
7,498,939 B2 * 3/2009 Goto et al. ..... 340/539.15
7,535,357 B2 * 5/2009 Enitan et al. ..... 340/571
7,696,887 B1 * 4/2010 Echavarria ..... 340/573.1
7,719,418 B2 * 5/2010 Grossman ..... 340/539.15
7,760,825 B2 * 7/2010 Alcouffe ..... 375/346
7,898,414 B2 * 3/2011 Spano ..... 340/571
2002/0126010 A1 * 9/2002 Trimble et al. ..... 340/568.1
2005/0190869 A1 * 9/2005 Alcouffe ..... 375/346
2006/0036353 A1 * 2/2006 Wintermantel ..... 700/300
2007/0290894 A1 * 12/2007 Ng et al. ..... 341/50

* cited by examiner

MOBILE TELEPHONE TRACKING SYSTEM

RELATED APPLICATIONS

The present invention was first described in and claims the benefit of U.S. Provisional Patent No. 60/966,159 filed Aug. 27, 2007, the entire disclosures of which are incorporated herein by reference.

FIELD OF THE INVENTION

The present invention relates generally to a personal item tracking and monitoring system and, more particularly, to a personal item tracking and monitoring system comprising a transmitter unit attached to an object that emits a radio frequency coded signal to a receiver unit carried by a person that alerts a user by an audible or visual warning signal if said object is located farther then a distance set by a user using a range selection control located on said receiver unit.

BACKGROUND OF THE INVENTION

Nothing is perhaps more frustrating than not being able to find common personal items that you just had in your hand minutes ago. These items include wireless phones, keys, eyeglass cases, remote controls, toys, and similar objects. They become easily lost due to their small size, and are accidentally left behind. They can fall on the floor, become lost in chairs and seat cushions or under furniture. Other times, they may be accidentally carried from the room and left elsewhere in the home or office. Whatever the reason, the frustration level is high while trying to locate them. Many valuable minutes of one's day can be spent simply looking for lost items. Accordingly, there is a need for a means by which common household or personal objects can be tracked easily and recovered quickly when misplaced. The development of the invention herein fulfills this need.

The present invention is a personal item tracking and monitoring system which wireless telephones or similar personal objects can be easily found by the use of a radio frequency system. It is intended to be used for finding objects such as cell phones, cordless phones, eyeglasses, remote controls, toys, tools, and similar objects that are easily and often misplaced around a home or work. A small transmitter unit is attached to the object to be tracked. The user then carries a small receiver unit on his or her person. The receiver unit is of the general size of a key fob and is provided with an on/off control and a range selection control that allows permissible ranges between the object and the receiver unit on the order to ten (10) feet to hundreds of feet. The transmitter emits a radio frequency coded signal either on a continuous or periodic basis. When the receiver unit receives this signal and it is of the strength required by the range selector or higher, the personal item tracking and monitoring system is in an armed and active state. However, when the object, or receiver unit, wander farther than the range control allows, the personal item tracking and monitoring system is in an alarm state and the receiver unit emits an audible tone or beep to remind the user to retrieve the object. The present invention can also be used as an aid to retrieve the tagged item when lost. This is accomplished by setting the range on the receiver unit on progressively smaller settings until the target area is identified. The use of the present invention reduces frustration by allowing for the easy tracking and location of common personal objects.

Several attempts have been made in the past to provide lost object locating systems. U.S. Pat. No. 5,939,981, issued in the name of Renney, describes an item locator with attachable receiver and transmitter. The Renney device comprises a hand held device and multiple sensors which are attached to objects a user desires to locate. However, unlike the present invention the Renney device does not provide a receiver unit that allows a user to adjust an allowable distance between a transmitter unit and the receiver unit. Furthermore, the Renney device does not provide a receiver unit that emits a warning signal when a length between a transmitter unit and the receiver unit reaches or extends beyond a programmable allowable distance.

U.S. Pat. No. 6,573,832, issued in the name of Fugere-Ramirez, discloses a locating device for finding lost personal items, such as keys, remote controls, a pager, a cellular phone, or a pair of eyeglasses. The Fugere-Ramirez device comprises a receiver that is attached to a personal item and a remote control transmitter that a user holds. When the user wants to find the personal item a button is pressed corresponding with the item to be found. The transmitter sends out a signal to the receiver that is received and then the receiver emits a beeping sound to help the user locate the personal item. However, unlike the present invention, the Fugere-Ramirez device produces a beeping sound on the lost personal item and does not emit a beeping sound on a hand-held device with the user thereby alerting the user when they are entering an area beyond a pre-set allowable distance from the personal item, thus enabling the user to know they need to find the personal item now.

U.S. Pat. No. 5,680,105, issued in the name of Hedrick, discloses a locating device for locating objects by means of matching coded sensors and receivers. The Hedrick device includes elements for attachment that are coded to respond to corresponding individual finders. However, unlike the present invention, the Hedrick device has a large number of parts which are subject to be lost themselves, is an extremely expensive locator device because of the high costs of having individual finders with separate circuits, and the elements are large and would not be appropriate for small personal objects.

U.S. Pat. No. 5,689,238, issued in the name of Cannon, Jr. et al., discloses an object locator system for finding marked documents in a random file in a file cabinet. The files are provided with a sound emitting device which is interrogated by a coded finder or a homing device which responds to a particular coded electronic signal sending device that produces an audible sound which increases in loudness upon approaching the file to be found. However, unlike the present invention, the Cannon, Jr. et al. system is restricted to a filing system environment.

The prior art appears to disclose various lost object locating systems. However, none of the prior art particularly describes a personal item tracking and monitoring system comprising a transmitter unit attached to an object that emits a radio frequency coded signal to a receiver unit carried by a person that alerts a user by an audible or visual warning signal if said object is located farther then a distance set by a user using a range selection control located on said receiver unit that the instant invention possesses. Accordingly, there is a need for a means by which common household or personal objects can be tracked easily and recovered quickly when misplaced that operates without the disadvantages as described above.

SUMMARY OF THE INVENTION

In view of the foregoing disadvantages inherent in the prior art, it has been observed that there is need for a personal item tracking and monitoring system and method by which wireless telephones or similar personal objects can be easily found by the use of a radio frequency system.

It is an object of the present invention to provide a personal item tracking and monitoring system allowing a user to be alerted if they go beyond a pre-set distance from a personal object.

A further object of the present invention is to provide a personal item tracking and monitoring system using a radio frequency system.

To achieve the above objectives, it is an object of the present invention to provide a personal item tracking and monitoring system comprising a transmitter unit and a receiver unit.

A further object of the present invention is having the transmitter unit removably attachable thereto an object by an attachment means and a receiver unit allowing a user to adjust an allowable distance between said transmitter unit and said receiver unit.

Another object of the present invention is having the transmitter unit transmit a radio frequency signal thereto a receiving antenna of the receiver unit thereby allowing the receiving unit to determine a length between the transmitter unit and the receiving unit.

Yet another object of the present invention is having the receiver unit emit a warning signal when the length between the transmitter unit and the receiver unit reaches or extends beyond the allowable distance and the personal item tracking and monitoring system is in an alarm state.

Still yet another object of the present invention is having the warning signal be audible.

Still yet another object of the present invention is having the warning signal by visual.

Yet still another object of the present invention is having the attachment means comprise a double-sided foam tape, an adhesive, a screw fastener, or a clip fastener.

Still another object of the present invention is utilizing a digital modulation scheme to produce a pulsed signal thereby avoiding interference with other said personal item tracking and monitoring systems in a nearby area or other devices which could be on a same or an adjacent frequency band.

Still yet another object of the present invention is having the transmitter unit further comprise a transmitter circuit electrically connected thereto a transmitting antenna and generating the radio frequency signal, the transmitting antenna that transmits the radio frequency signal, and a first battery providing power to the transmitter circuit.

Yet another object of the present invention is having the transmitter unit further comprise a first enclosure providing housing for the transmitter unit, a battery compartment cover for covering the first battery, and a battery compartment cover retaining means for opening and closing the battery compartment cover.

Still yet another object of the present invention is having the transmitter unit approximately one (1) inch long, three-quarters (¾) inch wide, and one-quarter (¼) inch thick.

Still yet another object of the present invention is having the receiver unit further comprise a second enclosure providing housing for the receiver unit, a digital display located thereon a face of the second enclosure allowing the user to view what the allowable distance has been set at, and a receiver circuit.

Yet still another object of the present invention is having the receiver unit further comprise the receiving antenna for receiving the radio frequency signal therefrom the transmitter unit and relaying the radio frequency signal thereto the receiver circuit, a squelch circuit electrically connected thereto the receiver circuit, and an increase alarm distance pushbutton and a decrease alarm distance pushbutton that allows the user to adjust the squelch circuit by adjusting the allowable distance between the transmitter unit and the receiver unit.

Still another object of the present invention is having the receiver unit further comprise a display driver circuit, a discrete controller which operates the increase alarm distance pushbutton and the decrease alarm distance pushbutton and is connected thereto the digital display by the display driver circuit, and an audible annunciator that receives an alarm indication signal when the personal item tracking and monitoring system is in the alarm state.

Yet another object of the present invention is having the receiver unit further comprise an alarm speaker that converts the alarm indication signal to an audible sound thereby alerting the user when the personal item tracking and monitoring system is in the alarm state, an on/off switch providing a means to control power thereto the receiving unit when in an on mode and allowing the user to deactivate the receiving unit when in an off mode, and a second battery providing power therethrough the on/off switch thereto the receiver circuit, the squelch circuit, the discrete controller, and the display driver circuit.

Another object of the present invention is having the receiver unit further comprise a crystal regulator, a clock circuit which receives inputs from the crystal regulator, and a first clock set pushbutton and a second clock set pushbutton that allows the user to adjust a time setting displayed on the digital display.

Yet another object of the present invention is having the clock circuit receive power therefrom the second battery but the power does not go therethrough the on/off switch thereby allowing the user to turn off the receiver unit without turning off the clock circuit.

Yet still another object of the present invention is having an attachment ring connected thereto the second enclosure thereby allowing the user to attach the receiver unit thereto a support structure adjacent thereto or located thereon the user.

Still another object of the present invention is having the receiver unit further comprise a belt clip connected thereto a rear side of the second enclosure.

Still yet another object of the present invention is having the receiver unit further comprise a low battery level indicator for indicating the user when a battery level of the transmitter unit and the receiver unit is low.

Yet another object of the present invention is having the low battery level indicator indicated through the receiver unit by use of a visual indication located thereon the digital display.

Yet another object of the present invention is having the low battery level indicator indicated through the receiver unit by use of an audible indication therewith the audible annunciator and the alarm speaker.

Yet still another object of the present invention is having the receiver unit approximately one (1) inch wide, one and one-quarter (1¼) inch long, and three-quarter (⅜) inch thick.

Another object of the present invention is having the discrete controller an integrated circuit that accepts digital and analog inputs and provides associated digital and analog outputs based upon a predetermined set of programmed instructions.

Still yet another object of the present invention is having the receiver unit further comprise a silence pushbutton enabling the user to deactivate the receiver unit for a short-term separation between the transmitter unit and the receiving unit wherein the receiver unit would be automatically reactivated upon return.

Still another object of the present invention is having the receiver unit further comprise a battery recharging port allowing the user to recharge the second battery.

Yet another object of the present invention is providing a method for using the present invention to allow the user to be alerted, if they go beyond a pre-set distance from a personal object.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
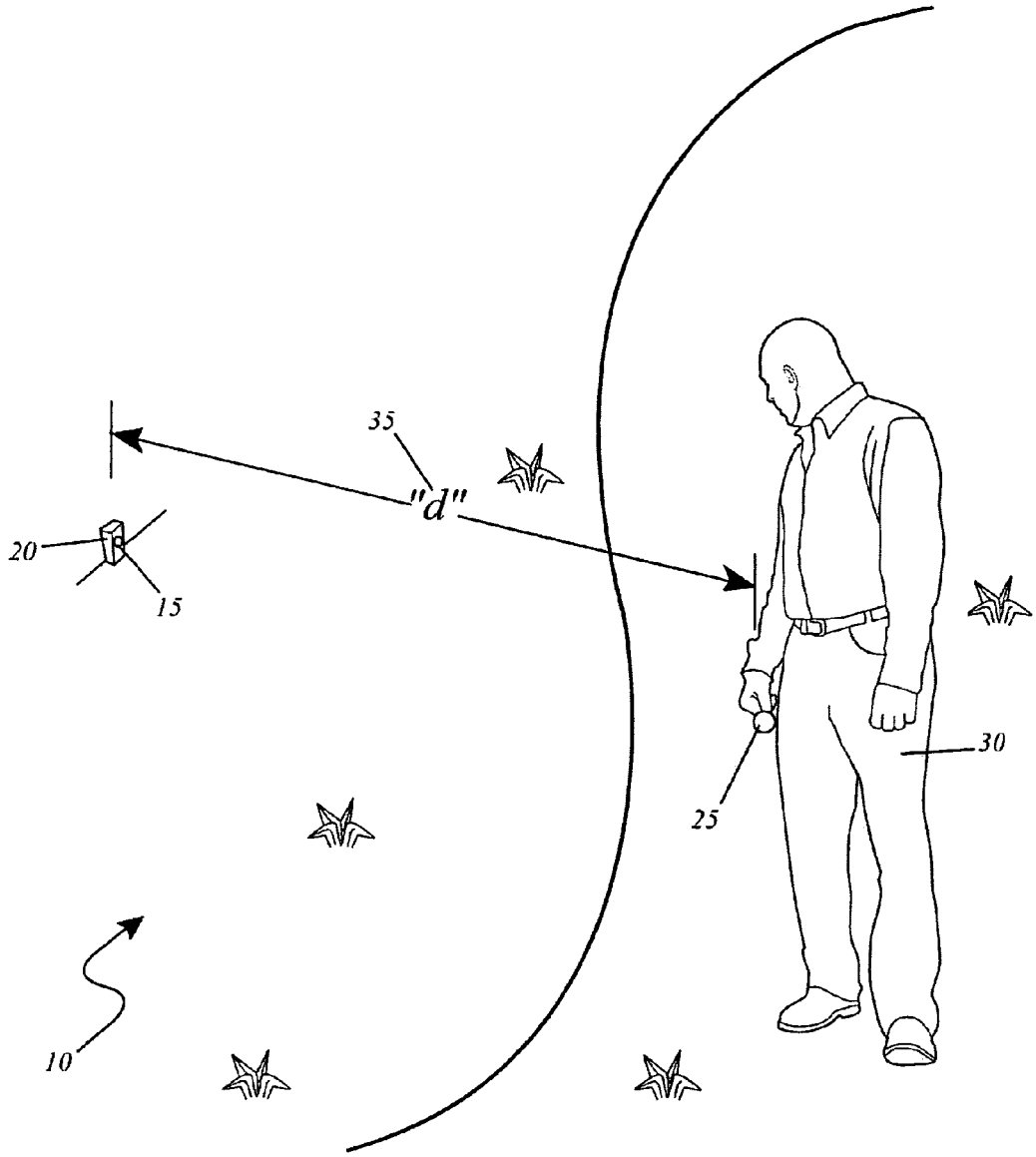
FIG. 1 is an overall perspective diagram of the personal item tracking and monitoring system 10 according to the preferred embodiment of the present invention.

10 personal item tracking and monitoring system
15 transmitter unit
20 personal object
25 receiver unit
30 user
35 distance "d"
40 first enclosure
45 physical attachment means
50 battery compartment cover
55 battery compartment cover retaining means
60 second enclosure
65 attachment ring
66 receiver battery compartment cover
67 belt clip
68 battery recharging port
70 digital display
75 first field
80 clock set pushbuttons
85 second field
87 battery low indicator
90 increase alarm distance pushbutton
95 decrease alarm distance pushbutton
100 alarm speaker
105 ON/OFF switch
110 silence pushbutton
115 first battery
120 transmitter circuit
125 internal transmitting antenna
130 radio frequency radio wave
135 receiving antenna
140 receiver circuit
145 squelch circuit
150 discrete controller
155 display driver circuit
160 audible annunciator
165 clock circuit
170 crystal regulator
175 second battery

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention is a personal item tracking and monitoring system 10 and method by which wireless telephones or similar personal objects 20 can be easily found by the use of a radio frequency system. A small transmitter unit 15 is attached to the object 20 to be tracked. The user then carries a small receiver unit 25. The receiver unit 25 is provided with an on/off control 105 and a means to select the allowable range of separation distance "d" 35 using an increase alarm distance pushbutton 90 and a decrease alarm distance pushbutton 95 with feedback from a digital display 70. When the object 20, or receiver unit 25, wander farther than the range control allows, the receiver unit 25 emits an audible tone or beep to remind the user to retrieve the object 20. Furthermore, the personal item tracking and monitoring system 10 can also be used as an aid to retrieve the tagged object 20 when lost. This is accomplished by setting the range on the receiver unit 25 on progressively smaller settings until the target area is identified.

Referring now to FIG. 1, an overall perspective diagram of the personal item tracking and monitoring system 10 according to the preferred embodiment of the present invention is disclosed. The personal item tracking and monitoring system 10 is comprised of two major but separate components. The first component, a transmitter unit 15 is provided on a personal object 20 such as a cellular telephone, an eyeglass case, a remote control, a portable computer, a personal digital assistant (PDA) or the like. The second component, a receiver unit 25, is carried by a user 30. The transmitter unit 15 is of a small size relative to the personal object 20 it is attached to the personal object 20 by use of a mechanical fastening means 45. The transmitter unit 15 and its fastening means will be described in greater detail herein below. The receiver unit 25 is envisioned to be the size of a key fob typically used to wirelessly lock and unlock the doors of a motor vehicle. As such, the receiver unit 25 is envisioned to be carried on a ring of keys, carried in one's hands, carried in a pocket, purse, or briefcase, worn upon a belt, or similar manner. The physical size and method of carrying or attachment of both the transmitter unit 15 and the receiver unit 25 do nor affect the features and benefits of the present invention, and as such, should not be interpreted as a limiting factor of the present invention. Under normal situations, since the transmitter unit 15 is permanently attached to the personal object 20, it would be present on or near the user 30, as would be expected with personal object 20 such as car keys, wireless telephones and the like. Under abnormal situations such as the case of theft, forgetfulness, unintentional removal, abandonment and the like, the distance between the transmitter unit 15 and the receiver unit 25 will increase as indicated by a distance "d" 35. When the distance "d" 35 reaches a predetermined and adjustable set point envisioned to be between 10 feet to 99 feet, the receiver unit 25 will emit an audible warning signal. In such a manner, the user 30 may take immediate corrective action to retrieve the personal object 20, thus silencing the audible alarm. Further functionality and operation of the transmitter unit 15 and the receiver unit 25 will be described in greater detail herein below.

Figure 2A:
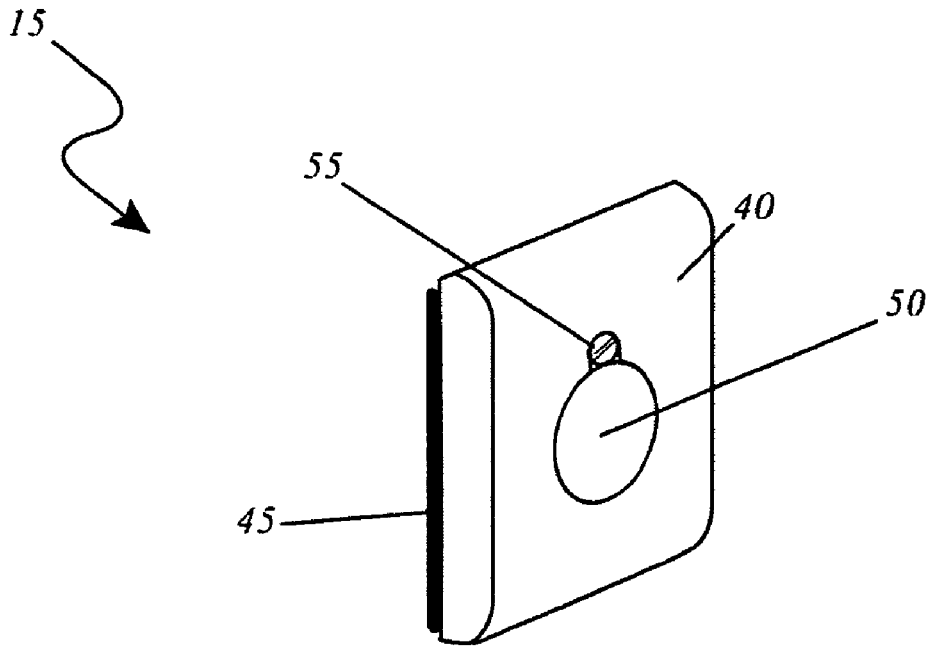
FIG. 2*a* is a front view of the transmitter unit 15 as used with the personal item tracking and monitoring system 10.

Referring next to FIG. 2*a*, a front view of the transmitter unit 15 as used with the personal item tracking and monitoring system 10 is shown. This figure more clearly shows the overall shape and size configuration of the transmitter unit 15. The transmitter unit 15 is housed in a first enclosure 40 envisioned to be provided with rounded corners. The overall size of the transmitter unit 15 is envisioned to be approximately one inch long, three-quarters (¾) inch wide and one-quarter (¼) inch thick. Such a size will not impart a physical burden to the personal object 20 (as shown in FIG. 1). On the face of the transmitter unit 15, a battery compartment cover 50 secured by a battery compartment cover retaining means 55 is provided. Such features are envisioned to be the only external features of the transmitter unit 15. There is no ON/OFF switch the transmitting antenna would be internal to the first enclosure 40. In such a manner, the transmitter unit 15 would be always active, and less likely to be deactivated as would be the case if the transmitter unit 15 were equipped with an ON/OFF switch.

Figure 2B:
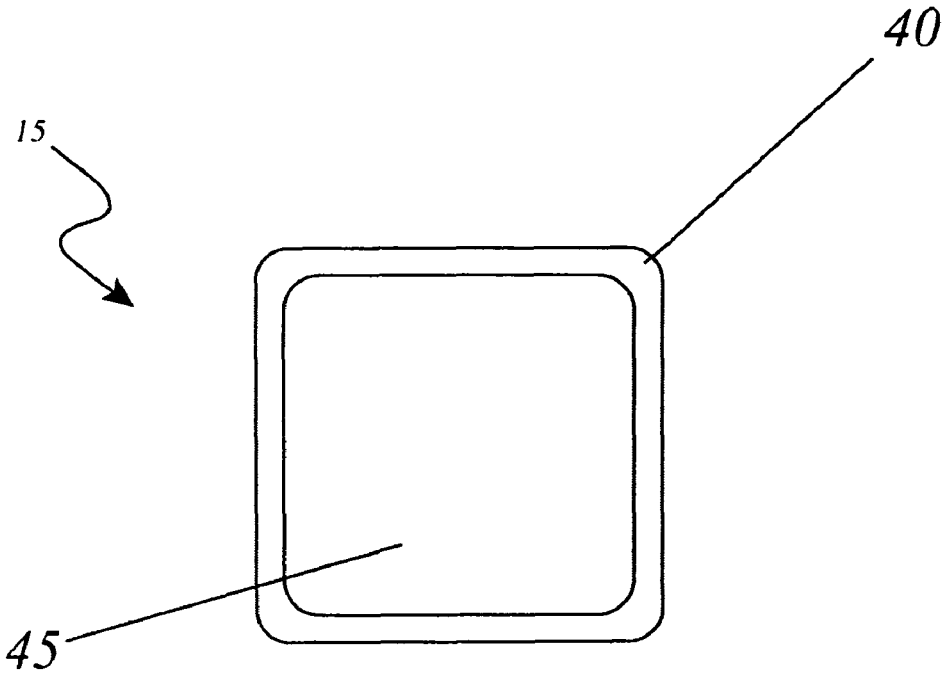
FIG. 2*b* is a rear view of the transmitter unit 15 as used with the personal item tracking and monitoring system 10.

Referring now to FIG. 2*b*, a rear view of the transmitter unit 15 as used with the personal item tracking and monitoring system 10 is disclosed. The rear of the first enclosure 40 of the transmitter unit 15 comprises a physical attachment means 45. The transmitter unit 15 is attached to the personal object 20 by the physical attachment means 45 such as double-sided foam tape, adhesive, or fasteners such as screws or clips. The preferred embodiment of the personal item tracking and monitoring system has the physical attachment means 45 covering almost the entire rear surface of the first enclosure 40 to provide a larger contact surface thereby providing a more secure attachment thereto the object 20.

Figure 3A:
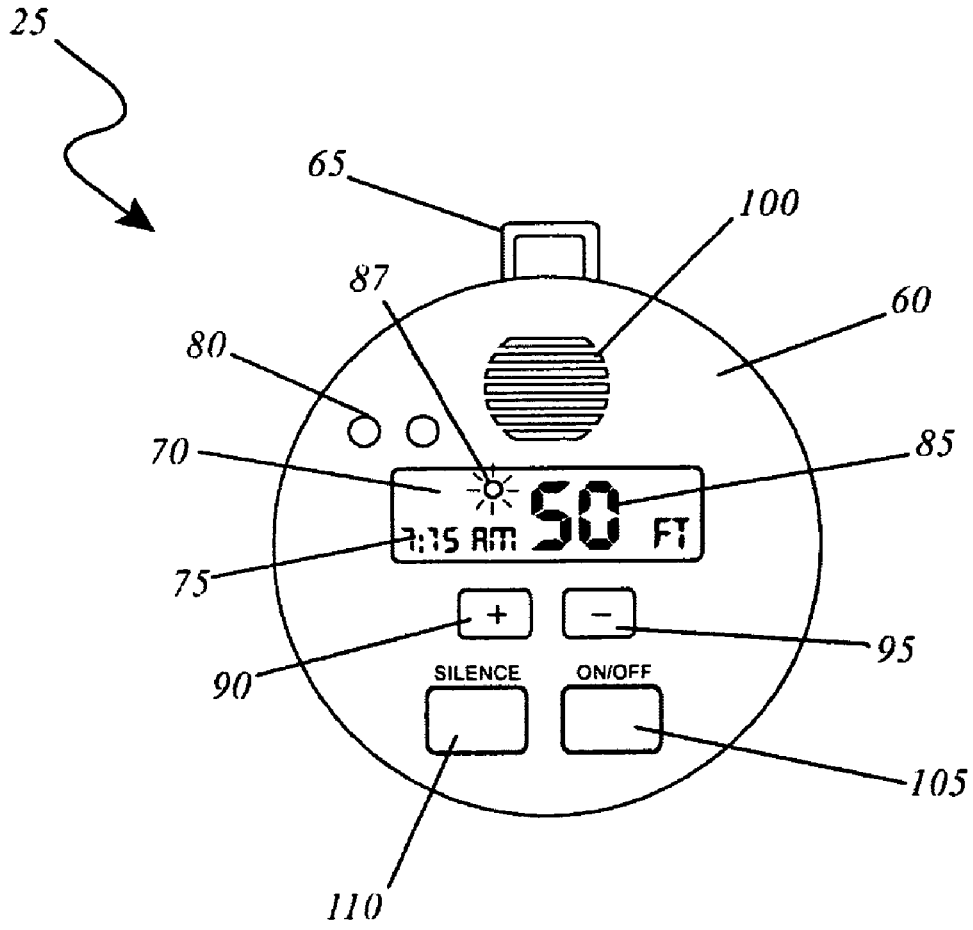
FIG. 3*a* is a front view of the receiver unit 25 as used with the personal item tracking and monitoring system 10.

Referring now to FIG. 3*a*, a front view of the receiver unit 25 as used with the personal item tracking and monitoring system 10 is depicted. The receiver unit 25 utilizes a second enclosure 60 envisioned to be the size of a key fob with the approximate overall dimensions of one (1) inch wide, one-and-a-quarter (1¼) inch tall and three-eighths (⅜) inch thick. An attachment ring 65 is provided on the top of the second enclosure 60 for attaching it to a ring of keys, a neck chain or the like. The face of the second enclosure 60 is provided with a digital display 70. A first field 75 of the digital display 70 indicates the current time. Such time is generated internally, and would be set by the use of a pair of clock set pushbuttons 80 in a conventional and expected manner. A second field 85 of the digital display 70 indicates the approximated distance "d" 35 (as shown in FIG. 1) at which point the receiver unit 25 will enter its alarm state. Such increases and decreases of said alarm distance is provided by use of an increase alarm distance pushbutton 90 and decrease alarm distance pushbutton 95 respectively. The audible annunciation associated with the use of the personal item tracking and monitoring system 10 is provided by an alarm speaker 100. The receiver unit 25 also provides a battery low indicator 87 thereupon the digital display 70 as well as providing a periodic beep emitted therefrom the audible annunciator 160.

An ON/OFF switch 105 provides power to the receiver unit 25. In such a manner the user 30 is able to deactivate the receiver unit 25 and associated personal item tracking and monitoring system 10 during periods of time when such separation between the transmitter unit 15 and the receiver unit 25 is long-term, repeated and intentional. Additionally, a silence pushbutton 110 is provided to allow intentional, single time, short-term separation, which would automatically re-activate the receiver unit 25 upon return. An example of such short term separation would be when one leaves a desk or car for a short time period and would leave behind personal items such as wireless phones, eyeglasses, computers and the like. When one returns, the receiver unit 25 would automatically reset and allow the receiver unit 25 to re-alarm when the user was separated again. This feature would alleviate having to remember to re-activate the receiver unit 25 when the user 30 would return.

Figure 3B:
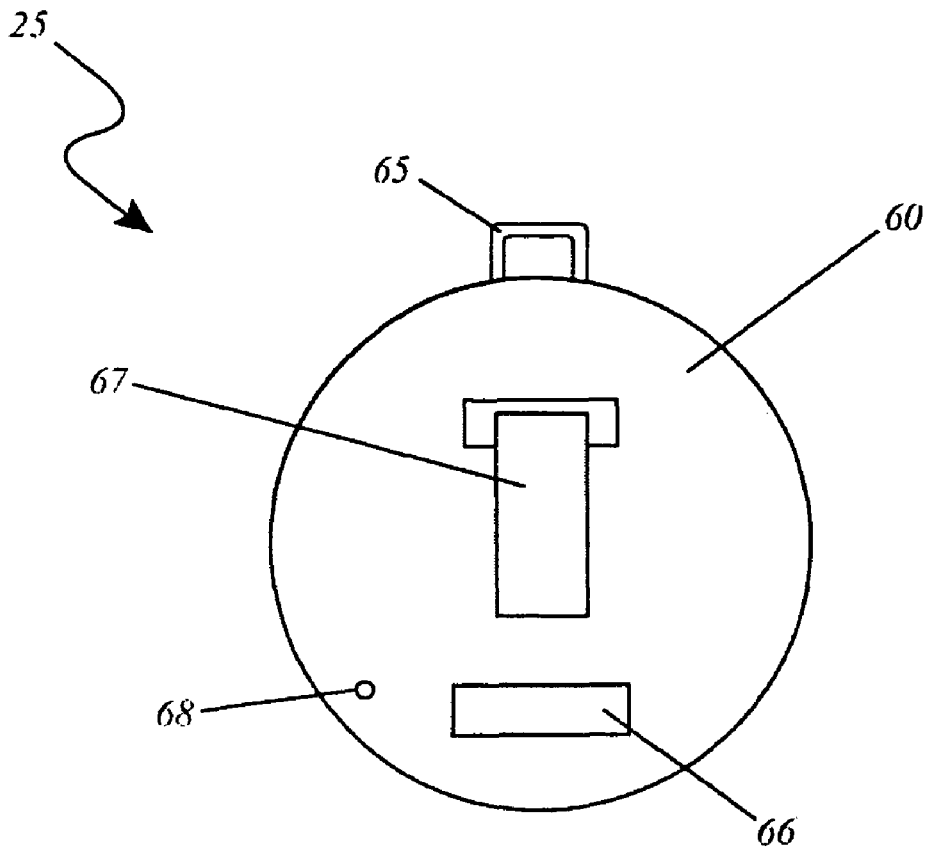
FIG. 3*b* is a rear view of the receiver unit 25 as used with the personal item tracking and monitoring system 10; and, FIG. 4 is an electronic block diagram of both the transmitter unit 15 and the receiver unit 25 as used with the personal item tracking and monitoring system 10.

Referring now to FIG. 3*b*, a rear view of the receiver unit 25 as used with the personal item tracking and monitoring system 10 is depicted. The receiver unit 25 further comprises a receiver battery compartment cover 66, a belt clip 67, and a battery recharging port 68 on the rear of the second enclosure 60. The belt clip 67 would be provided on the rear of the second enclosure 60 and allow for attachment to a belt, a strap or the like. The receiver unit 25 is battery powered and would allow for replaceable batteries or the recharging of rechargeable batteries through an access opening or a battery recharging port 68 on the rear of the second enclosure 60.

Figure 4:
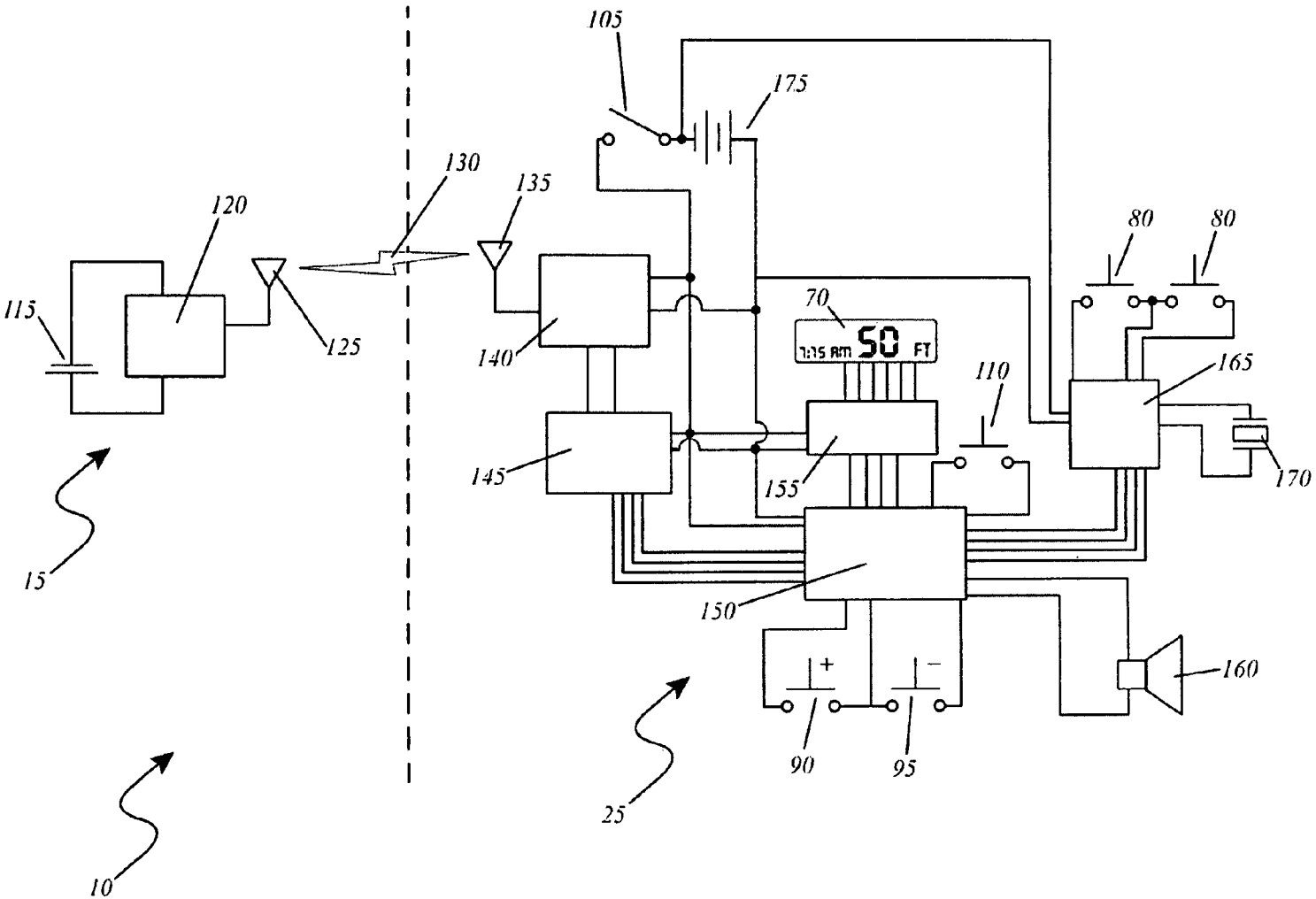

Referring finally to FIG. 4, an electronic block diagram of the transmitter unit 15 as used with the receiver unit 25 is shown. The transmitter unit 15 is shown on the left-hand side of the diagram. A first battery 115 provides power to a transmitter circuit 120, which is interconnected to an internal transmitting antenna 125 as shown. The transmitter circuit 120 generates a radio frequency radio wave signal 130. The internal transmitting antenna 125 transmits the radio frequency radio wave 130 which provides indication to a receiving antenna 135 as to the presence of the transmitter unit 15 and its relative strength. The radio frequency radio wave 130 is envisioned to be of the type licensed for use on appropriate frequencies and modulation schemes. While a multitude of different modulation schemes such as amplitude modulation, frequency modulation, side-band, and the like could be utilized, it is envisioned that digital modulation which would produce a pulsed signal would be best due to its ability to be modulated to avoid interference with other personal item tracking and monitoring system 10 in the nearby area or other devices which may be on the same or adjacent frequency bands. However, any specific modulation scheme is not required by the present invention, and as such, should not be interpreted as a limiting factor of the present invention. The receiving antenna 135 relays the radio frequency radio wave 130 to a receiver circuit 140. The receiver circuit 140 is in turn connected to a squelch circuit 145 which operates in a manner similar to that of a squelch circuit on a conventional radio. The squelch circuit 145 comprises a preset threshold value for the radio frequency signal 130, thereby detecting an acceptable proximal location of the transmitter unit 15. As such, if a radio frequency signal 130 being of an adequate strength and being above said preset threshold is detected, the squelch is broken and the personal item tracking and monitoring system 10 is in an armed and active state. Should the strength of the radio frequency radio wave 130 drop below the preset threshold, as would be the case if the transmitter unit 15 is displaced a distance away, the squelch will close and the receiver unit 25 will enter an alarm state. The adjustment of the squelch circuit 145 is controlled by the increase alarm distance pushbutton 90 and the decrease alarm distance pushbutton 95 which operate through a discrete controller 150. The discrete controller 150 is envisioned to be a dedicated integrated circuit that accepts digital and analog inputs and provided associated digital and analog outputs based upon a predetermined set of programmed instructions. Such design can also be provided by a basic stamp controller, an analog circuit driven into saturation, or the like, and as such, one particular design should not be interpreted as a limiting factor of the present invention. The discrete controller 150 connects to the digital display 70 through use of a display driver circuit 155. Alarm indication output is made to an audible annunciator 160 from the discrete controller 150 as well. A clock circuit 165 with inputs from a crystal regulator 170 and the clock set pushbuttons 80 provide display of the current time to the digital display 70 as well. Finally, a second battery 175 provides power through the ON/OFF switch 105 to the receiver circuit 140, the squelch circuit 145, the discrete controller 150, and the display driver circuit 155. Power is also provided to the clock circuit 165 as well, but before the ON/OFF switch 105 such as to not interrupt time keeping ability when the receiver unit 25 is switched off.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After procurement of the personal item tracking and monitoring system 10, the user would install an appropriate first battery 115 and second battery 175 in the transmitter unit 15 and receiver unit 25 respectively. The user 30 would then set the appropriate time of day on the receiver unit 25 using the clock set pushbuttons 80. Next, the user 30 would adjust the receiver unit 25 for an allowable separation distance "d" 35 using the increase alarm distance pushbutton 90 and the decrease alarm distance pushbutton 95 with feedback from the digital display 70. At this point the personal item tracking and monitoring system 10 is ready for use and monitoring.

Should the receiver unit 25 be separated from the transmitter unit 15, thus including the personal object 20, for an approximate distance greater than that permitted by the receiver unit 25, an audible alarm will sound through the audible annunciator 160. This provides adequate warning to the user 30 to take preemptive action and retrieve the associated personal object 20. Should the user 30 allow such separation, the silence pushbutton 110 would be pressed to temporarily silence the audible annunciator 160. However, once the transmitter unit 15 returns within the distance "d" 35, the receiver unit 25 will automatically reset and thus alarm again should the distance "d" 35 be exceeded. In the event the features of the personal item tracking and monitoring system 10 are not required, the user 30 can deactivate the receiver unit 25 by use of the ON/OFF switch 105.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A personal item tracking and monitoring system, comprising:

a transmitter unit removably attachable to an object by an attachment means; and, a receiver unit allowing a user to adjust an allowable distance between said transmitter unit and said receiver unit, further comprising:

a second enclosure providing housing for said receiver unit;

a digital display located on a face of said second enclosure allowing said user to view what said allowable distance has been set at;

a receiver circuit;

a receiving antenna for receiving a radio frequency signal from said transmitter unit and relaying said radio frequency signal to said receiver circuit;

a squelch circuit electrically connected to said receiver circuit;

an increase alarm distance pushbutton and a decrease alarm distance pushbutton that allows said user to adjust said squelch circuit by adjusting said allowable distance between said transmitter unit and said receiver unit;

a display driver circuit;

a discrete controller which operates said increase alarm distance pushbutton and said decrease alarm distance pushbutton and is connected to said digital display by said display driver circuit;

an audible annunciator that receives an alarm indication signal when said personal item tracking and monitoring system is in an alarm state;

an alarm speaker that converts said alarm indication signal to an audible sound thereby alerting said user when said personal item tracking and monitoring system is in said alarm state;

an on/off switch providing a means to control power to said receiving unit when in an on mode and allowing said user to deactivate said receiving unit when in an off mode; and, a second battery providing power through said on/off switch to said receiver circuit, said squelch circuit, said discrete controller, and said display driver circuit;

wherein said length between said transmitter unit and said receiver unit is determined by a signal strength transmitted by said transmitter unit to said receiver unit;

wherein when said signal strength of said radio frequency signal is of an adequate strength, said squelch circuit is broken and said personal item tracking and monitoring system is in an armed and active state;

wherein when said signal strength of said radio frequency signal does not reach said adequate strength, said squelch circuit is closed and said receiver unit enters said alarm state;

wherein said transmitter unit transmits said radio frequency signal to said receiving antenna of said receiver unit thereby allowing said receiving unit to determine a length between said transmitter unit and said receiving unit; and, wherein said receiver unit emits a warning signal when said length between said transmitter unit and said receiver unit reaches or extends beyond said allowable distance and said personal item tracking and monitoring system is in said alarm state.

2. The personal item tracking and monitoring system of claim 1, wherein said warning signal is audible.

3. The personal item tracking and monitoring system of claim 1, wherein said warning signal is visual.

4. The personal item tracking and monitoring system of claim 1, wherein said attachment means comprises one (1) of the following list: a double-sided foam tape, an adhesive, a screw fastener, or a clip fastener.

5. The personal item tracking and monitoring system of claim 1, wherein said system utilizes a digital modulation scheme to produce a pulsed signal thereby avoiding interference with other said personal item tracking and monitoring systems in a nearby area or other devices which could be on a same or an adjacent frequency band.

6. The personal item tracking and monitoring system of claim 1, wherein said transmitter unit further comprises:

a transmitter circuit electrically connected to a transmitting antenna and generating said radio frequency signal;

said transmitting antenna that transmits said radio frequency signal; and, a first battery providing power to said transmitter circuit;

wherein said transmitter unit transmits said radio frequency signal thereby allowing said receiving antenna to determine said length between said transmitter unit and said receiving unit.

7. The personal item tracking and monitoring system of claim 6, wherein said transmitter unit further comprises:

a first enclosure providing housing for said transmitter unit;

a battery compartment cover for covering said first battery; and, a battery compartment cover retaining means for opening and closing said battery compartment cover.

8. The personal item tracking and monitoring system of claim 7, wherein said transmitter unit is approximately one (1) inch long, three-quarters (¾) inch wide, and one-quarter (¼) inch thick.

9. The personal item tracking and monitoring system of claim 1, wherein said receiver unit further comprises:

a crystal regulator;

a clock circuit which receives inputs from said crystal regulator; and, a first clock set pushbutton and a second clock set pushbutton that allows said user to adjust a time setting displayed on said digital display;

wherein said clock circuit receives power from said second battery but said power does not go through said on/off switch thereby allowing said user to turn off said receiver unit without turning off said clock circuit.

10. The personal item tracking and monitoring system of claim 9, wherein said receiver unit further comprises an attachment ring connected to said second enclosure thereby allowing said user to attach said receiver unit to a support structure adjacent to or located on said user.

11. The personal item tracking and monitoring system of claim 9, wherein said receiver unit further comprises a belt clip connected to a rear side of said second enclosure.

12. The personal item tracking and monitoring system of claim 9, wherein said receiver unit further comprises a low battery level indicator for indicating said user when a battery level of said transmitter unit and said receiver unit is low.

13. The personal item tracking and monitoring system of claim 12, wherein said low battery level indicator is indicated through said receiver unit by use of a visual indication located on said digital display.

14. The personal item tracking and monitoring system of claim 12, wherein said low battery level indicator is indicated through said receiver unit by use of an audible indication said audible annuciator and said alarm speaker.

15. The personal item tracking and monitoring system of claim 9, wherein said receiver unit is approximately one (1) inch wide, one-and-a-quarter (1¼) inch long, and three-quarter (⅜8) inch thick.

16. The personal item tracking and monitoring system of claim 9, wherein said discrete controller is an integrated circuit that accepts digital and analog inputs and provides associated digital and analog outputs based upon a predetermined set of programmed instructions.

17. The personal item tracking and monitoring system of claim 9, wherein said receiver unit further comprises a silence pushbutton enabling said user to deactivate said receiver unit for a short-term separation between said transmitter unit and said receiving unit wherein said receiver unit would be automatically re-activated upon return.

18. The personal item tracking and monitoring system of claim 9, wherein said receiver unit further comprises a battery recharging port allowing said user to recharge said second battery.

19. A method for using a personal item tracking and monitoring system, said method comprising the steps of:

providing said system, comprising:

a transmitter unit removably attachable to an object by an attachment means; and, a receiver unit allowing a user to adjust an allowable distance between said transmitter unit and said receiver unit, further comprising:

a second enclosure providing housing for said receiver unit;

a digital display located on a face of said second enclosure allowing said user to view what said allowable distance has been set at;

a receiver circuit;

a receiving antenna for receiving a radio frequency signal from said transmitter unit and relaying said radio frequency signal to said receiver circuit;

a squelch circuit electrically connected to said receiver circuit;

an increase alarm distance pushbutton and a decrease alarm distance pushbutton that allows said user to adjust said squelch circuit by adjusting said allowable distance between said transmitter unit and said receiver unit;

a display driver circuit;

a discrete controller which operates said increase alarm distance pushbutton and said decrease alarm distance pushbutton and is connected to said digital display by said display driver circuit;

an audible annunciator that receives an alarm indication signal when said personal item tracking and monitoring system is in an alarm state;

an alarm speaker that converts said alarm indication signal to an audible sound thereby alerting said user when said personal item tracking and monitoring system is in said alarm state;

an on/off switch providing a means to control power to said receiving unit when in an on mode and allowing said user to deactivate said receiving unit when in an off mode; and, a second battery providing power through said on/off switch to said receiver circuit, said squelch circuit, said discrete controller, and said display driver circuit;

wherein said length between said transmitter unit and said receiver unit is determined by a signal strength transmitted by said transmitter unit to said receiver unit;

wherein when said signal strength of said radio frequency signal is of an adequate strength, said squelch circuit is broken and said personal item tracking and monitoring system is in an armed and active state;

wherein when said signal strength of said radio frequency signal does not reach said adequate strength, said squelch circuit is closed and said receiver unit enters said alarm state;

wherein said transmitter unit transmits said radio frequency signal thereto said receiving antenna of said receiver unit thereby allowing said receiving unit to determine a length between said transmitter unit and said receiving unit; and, wherein said receiver unit emits a warning signal when said length between said transmitter unit and said receiver unit reaches or extends beyond said allowable distance and said personal item tracking and monitoring system is in said alarm state;

installing a first battery in said transmitter unit and a second battery said receiver unit;

setting an appropriate time of day on said receiver unit using a first clock set pushbutton and a second clock set pushbutton;

adjusting said allowable distance between said transmitter unit and said receiver unit using an increase alarm distance pushbutton and a decrease alarm distance pushbutton with feedback from a digital display; and, utilizing said personal item tracking and monitoring system to alert said user if said personal object goes beyond said allowable distance.

20. A personal item tracking and monitoring system, comprising:

a transmitter unit further comprising:

a transmitter circuit electrically connected to a transmitting antenna and generating said radio frequency signal;

said transmitting antenna that transmits said radio frequency signal; and, a first battery providing power to said transmitter circuit;

a receiver unit further comprising:

a second enclosure providing housing for said receiver unit;

a digital display located on a face of said second enclosure allowing said user to view what said allowable distance has been set at;

a receiver circuit;

a receiving antenna for receiving a radio frequency signal from said transmitter unit and relaying said radio frequency signal to said receiver circuit;

a squelch circuit electrically connected to said receiver circuit;

an increase alarm distance pushbutton and a decrease alarm distance pushbutton that allows said user to adjust said squelch circuit by adjusting said allowable distance between said transmitter unit and said receiver unit;

a display driver circuit;

a discrete controller which operates said increase alarm distance pushbutton and said decrease alarm distance pushbutton and is connected to said digital display by said display driver circuit;

an audible annunciator that receives an alarm indication signal when said personal item tracking and monitoring system is in said alarm state;

an alarm speaker that converts said alarm indication signal to an audible sound thereby alerting said user when said personal item tracking and monitoring system is in said alarm state;

an on/off switch providing a means to control power to said receiving unit when in an on mode and allowing said user to deactivate said receiving unit when in an off mode; and, a second battery providing power through said on/off switch thereto said receiver circuit, said squelch circuit, said discrete controller, and said display driver circuit;

wherein said transmitter unit is removably attachable to an object by an attachment means;

wherein said length between said transmitter unit and said receiver unit is determined by a signal strength transmitted by said transmitter unit to said receiver unit;

wherein when said signal strength of said radio frequency signal is of an adequate strength, said squelch circuit is broken and said personal item tracking and monitoring system is in an armed and active state;

wherein when said signal strength of said radio frequency signal does not reach said adequate strength, said squelch circuit is closed and said receiver unit enters said alarm state;

wherein said receiver unit allows a user to adjust an allowable distance between said transmitter unit and said receiver unit;

wherein said transmitter unit transmits said radio frequency radio wave said receiving antenna of said receiver unit thereby allowing said receiving unit to determine a length between said transmitter unit and said receiving unit; and, wherein said receiver unit emits a warning signal when said length between said transmitter unit and said receiver unit reaches or extends beyond said allowable distance and said personal item tracking and monitoring system is in said alarm state.

21. The personal item tracking and monitoring system of claim 20, wherein said attachment means comprises one (1) of the following list: a double-sided foam tape, an adhesive, a screw fastener, or a clip fastener.

* * * * *